US007837320B2

(12) United States Patent
Mohri et al.

(10) Patent No.: US 7,837,320 B2
(45) Date of Patent: Nov. 23, 2010

(54) LIQUID DROPLET EJECTION APPARATUS

(75) Inventors: Satoshi Mohri, Kanagawa (JP); Hiroaki Satoh, Kanagawa (JP); Koichi Saitoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 484 days.

(21) Appl. No.: 11/450,013

(22) Filed: Jun. 9, 2006

(65) Prior Publication Data

US 2007/0109386 A1 May 17, 2007

(30) Foreign Application Priority Data

Nov. 14, 2005 (JP) ..... 2005-328761

(51) Int. Cl.
*B41J 2/01* (2006.01)

(52) U.S. Cl. ..... 347/104; 399/26; 399/44; 399/55; 399/66; 399/148; 399/298; 399/299; 399/303

(58) Field of Classification Search ..... 347/101, 347/104, 105, 103, 102
See application file for complete search history.

(56) References Cited

U.S. PATENT DOCUMENTS 5,970,277 A * 10/1999 Shigeta et al. ..... 399/45
6,385,417 B1 * 5/2002 Tanaka et al. ..... 399/164
6,405,006 B1 * 6/2002 Tabuchi ..... 399/162
2001/0028381 A1 * 10/2001 Kashiwagi et al. ..... 347/104
2004/0041897 A1 * 3/2004 Chino et al. ..... 347/153
2006/0050124 A1 * 3/2006 Adachi ..... 347/104

FOREIGN PATENT DOCUMENTS

| | | |
|---|---|---|
| JP | 7-301973 | 11/1995 |
| JP | 10-193585 | 7/1998 |
| JP | 2873879 | 1/1999 |
| JP | 2001-194868 | 7/2001 |
| JP | 2003-103857 | 4/2003 |

* cited by examiner

*Primary Examiner*—Stephen D Meier
*Assistant Examiner*—Alexander C Witkowski
(74) *Attorney, Agent, or Firm*—Fildes & Outland, P.C.

(57) ABSTRACT

A liquid droplet ejection apparatus comprising a liquid droplet ejection head that ejects liquid droplets, a conveyor belt that retains and conveys a recording medium while causing the recording medium to face the liquid droplet ejection head, and a charge roll that causes the recording medium to be electrostatically attracted to the conveyor belt. The charge roll and the conveyor belt are configured not to contact each other, and a gap between the charge roll and the conveyor belt is less than the thickness of the recording medium.

8 Claims, 12 Drawing Sheets

LIQUID DROPLET EJECTION APPARATUS

CROSS-REFERENCE TO RELATED APPLICATION

This application claims priority under 35 USC 119 from Japanese Patent Application, No. 2005-328761 the disclosure of which is incorporated by reference herein.

BACKGROUND OF THE INVENTION

1. Technical Field

The present invention relates to a liquid droplet ejection apparatus comprising a liquid droplet ejection head that ejects liquid droplets, a conveyor belt that retains and conveys a recording medium while causing the recording medium to face the liquid droplet ejection head, and a charge roll that causes the recording medium to be electrostatically attracted to the conveyor belt.

2. Related Art

In inkjet printers serving as liquid droplet ejection apparatus, a charge roll presses a paper against a conveyor member such as a conveyor belt or conveyor drum and charges the paper, whereby electrostatic attractive force is created between the paper and the conveyor member and causes the paper to be attracted to the conveyor member. Then, the paper is passed through a region where ink droplets are ejected onto the paper from a recording head, and an image is recorded on the paper. Thus, there is greater uniformity of the distance between the paper and the nozzle surface of the recording head (called "throw distance" hereinafter), the precision of the landing positions of the ink droplets on the paper is improved, and image quality is improved.

In order to increase the uniformity of the throw distance, making the electrostatic attractive force between the paper and the conveyor member stronger is required. And in order to ensure that the uniformity of the throw distance does not drop due to environmental changes, such as changes in temperature and humidity, and to differences in the type of paper, making the electrostatic attractive force between the paper and the conveyor member even stronger is required. In recent years, in order to further improve the precision of the landing positions of the ink droplets on the paper and achieve better image quality, the distance between the paper and the nozzle surface of the recording head has been reduced to 1 to 2 mm.

For this reason, as shown in FIG. 10, the electrostatic attractive force created between a recording head 32 and a conveyor belt 28 becomes strong and the conveyor belt 28 may rise and contact the recording head 32. When the conveyor belt 28 contacts the recording head 32, the conveyor belt 28 becomes soiled with ink, the ink moves from one recording head 32 to another recording head 32 via the conveyor belt 28 such that colors become mixed, and foreign matter adhering to the conveyor belt 28 enters the insides of the recording heads 32 through the nozzles. Particularly in a system that uses transparent ink (reaction liquid) that causes an agglutination reaction when it is mixed with yellow (Y), magenta (M), cyan (C) and black (K) inks (two-liquid system) or a system that causes inks of different colors such as black and yellow to mix and react (inter-ink reaction system) with the purpose of improving image quality, when agglutination of and color changes in the ink occur in the recording heads 32, it is difficult to recover the systems.

As shown in FIG. 11, in a normal state of a conventional inkjet printer, the portion where a charge roll 36 and the conveyor belt 28 contact each other has high resistance so that it becomes difficult for electrical charge to move, and the movement of electrical charge between the charge roll 36 and the conveyor belt 28 results from discharge in the region of a tiny gap between the charge roll 36 and the conveyor belt 28. However, when water droplets or ink droplets adhere to the portion where the charge roll 36 and the conveyor belt 28 contact each other, this portion has low resistance (abnormal state), and the movement of electrical charge occurs at this portion. For this reason, as shown in the graph of FIG. 12, the surface potential of the conveyor belt 28 in an abnormal state rises in comparison to that in the normal state, which affects the rising of the conveyor belt 28 and the uniformity of the throw distance.

An abnormal rise in the surface potential of a charged member can be prevented by ensuring that the charge roll does not contact the charged member. However, when the charge roll is configured such that it does not contact the conveyor belt and does not press the paper against the conveyor belt, sufficient attractive force cannot be applied between the paper and the conveyor belt.

SUMMARY

One embodiment of the invention provides a liquid droplet ejection apparatus comprising a liquid droplet ejection head that ejects liquid droplets; a conveyor belt that retains and conveys a recording medium while causing the recording medium to face the liquid droplet ejection head; and a charge roll that causes the recording medium to be electrostatically attracted to the conveyor belt. The charge roll and the conveyor belt are configured such that they do not contact each other, and a gap between the charge roll and the conveyor belt is less than the thickness of the recording medium. Note that the gap between the charge roll and the conveyor belt represents the shortest distance between the charge roll and the conveyor belt where they do not contact each other.

BRIEF DESCRIPTION OF THE DRAWINGS

Embodiments of the present invention will be described in detail based on the following figures, wherein.

DESCRIPTION

Embodiments of the present invention will be described below with reference to the drawings.

Figure 1:
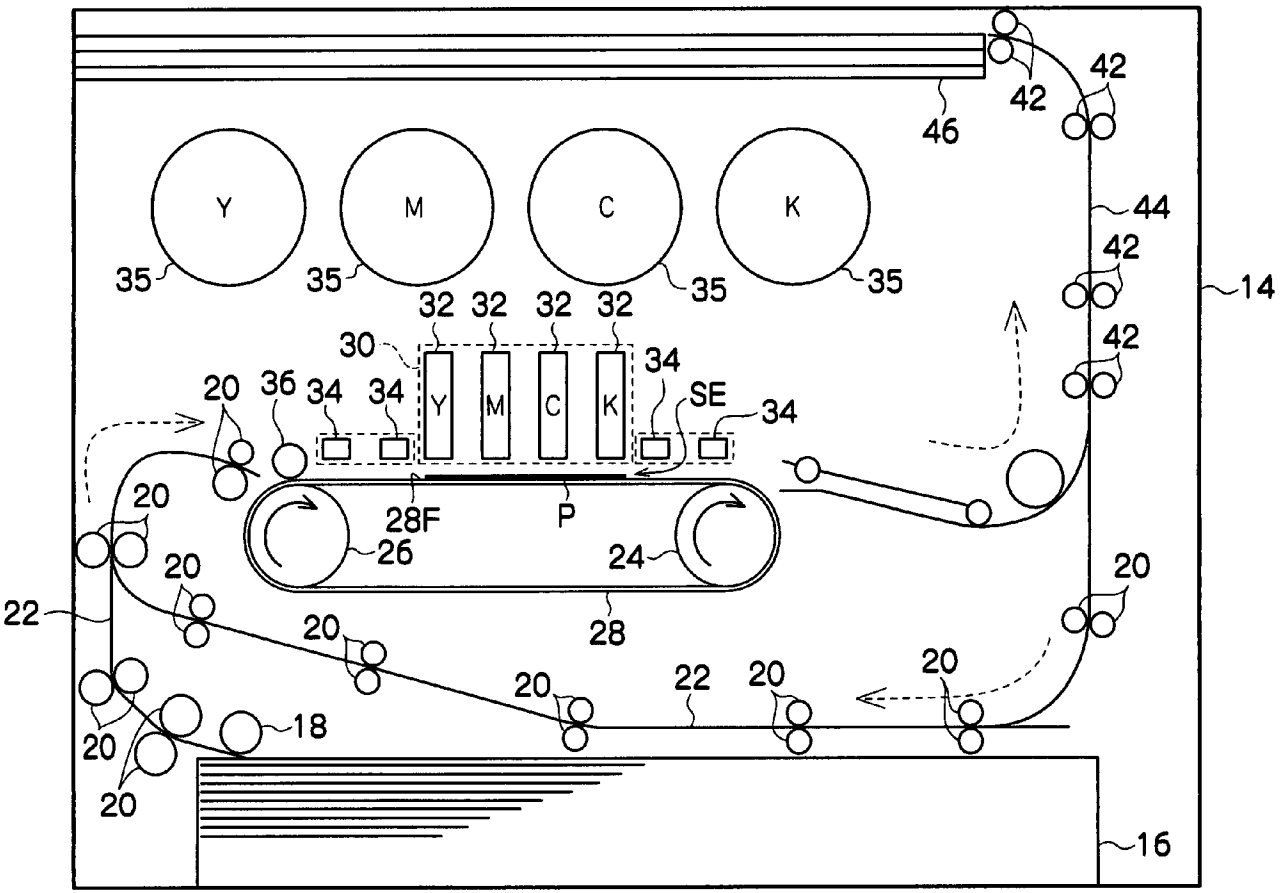
FIG. 1 is a schematic side view showing an inkjet recording apparatus pertaining to an embodiment of the invention.

FIG. 1 shows an inkjet recording apparatus 12 pertaining to one embodiment of the present invention. The inkjet recording apparatus 12 includes a casing 14 in whose lower portion a paper supply tray 16 is disposed. Sheets of paper P stacked in the paper supply tray 16 are picked up one sheet at a time by a pickup roll 18. The picked-up paper P is conveyed by plural conveyance roll pairs 20 that configure a predetermined conveyance path 22.

An endless conveyor belt 28 is stretched around a drive roll 24 and a driven roll 26 above the paper supply tray 16. A recording head array 30 is disposed above the conveyor belt 28, and the recording head array 30 faces a flat portion 28F of the conveyor belt 28. This region, where the recording head array 30 faces the flat portion 28F of the conveyor belt 28, serves as an ejection region SE where ink droplets are ejected from the recording head array 30. The paper P conveyed on the conveyance path 22 is retained and conveyed by the conveyor belt 28 to the ejection region SE, where ink droplets corresponding to image information are ejected from the recording head array 30 and adhere to the paper P in a state where the paper P faces the recording head array 30.

The recording head array 30 is configured as a long recording head array such that its effective recording region is equal to or greater than the width of the paper P (the length of the paper P in the direction orthogonal to the conveyance direction). The recording head array 30 includes four inkjet recording heads ("recording heads" hereunder) 32 that correspond to the four colors of yellow (Y), magenta (M), cyan (C) and black (K) and are disposed along the conveyance direction, whereby the recording head array 30 is capable of recording a full-color image.

Each recording head 32 is driven by a head drive circuit (not shown). The head drive circuits are configured to determine, in accordance with the image information, the timing at which the ink droplets are to be ejected and the ink ejection ports (nozzles) that are to be used, and to send drive signals to the recording heads 32.

The recording head array 30 may be configured such that it is immovable in the direction orthogonal to the conveyance direction, but when it is configured to move as needed, an image with higher resolution can be recorded by multi-pass image recording, and it can be ensured that any flaws in the recording heads 32 are not reflected in the recording result.

Figure 2:
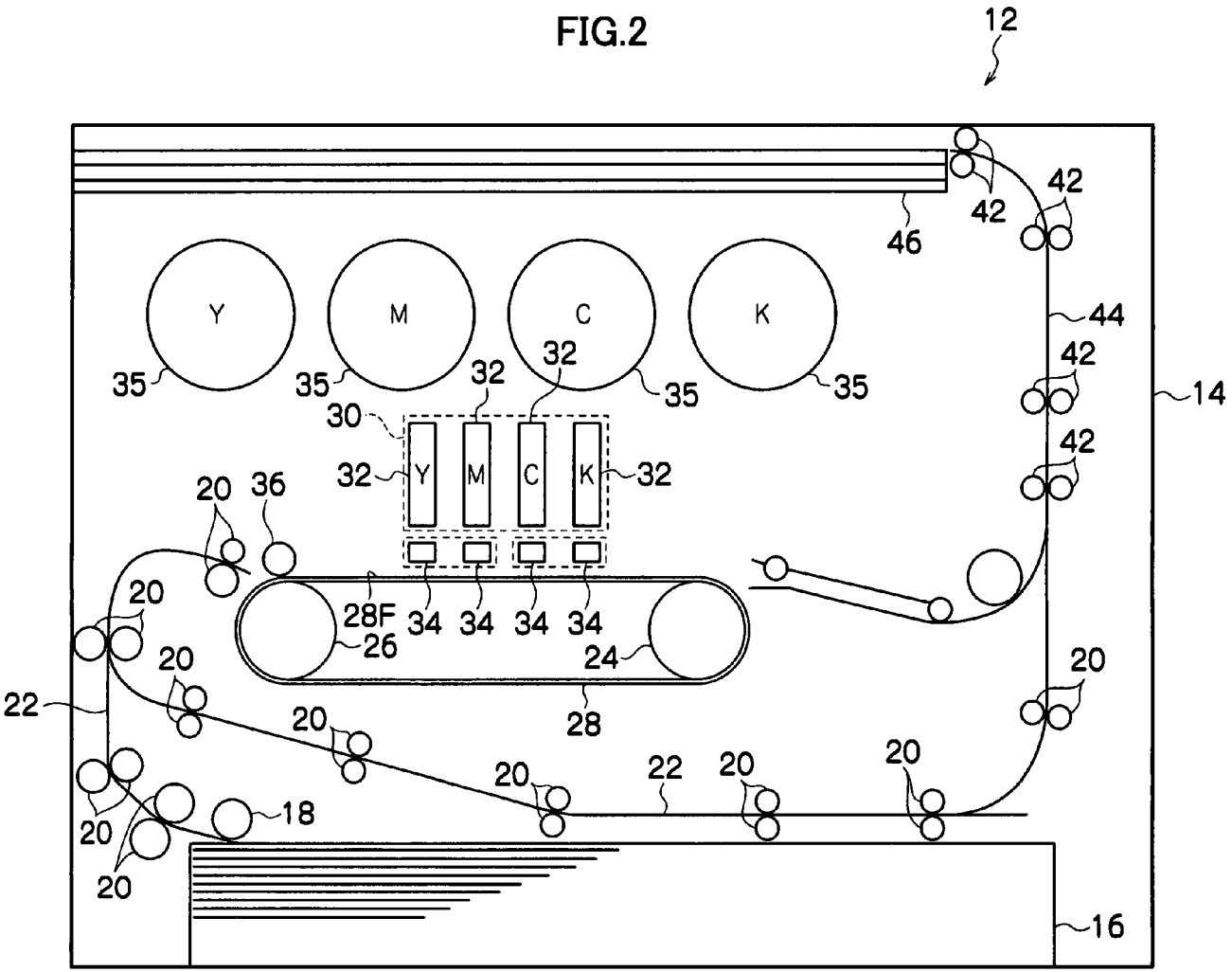
FIG. 2 is a schematic side view showing the inkjet recording apparatus pertaining to an embodiment of the invention.

A total of four maintenance units 34 corresponding to the recording heads 32 are disposed on both sides of the recording head array 30. As shown in FIG. 2, when maintenance is to be conducted with respect to the recording heads 32, the recording head array 30 is moved upward and the maintenance units 34 move into a gap configured between the recording head array 30 and the conveyor belt 28. Then, the maintenance units 34 conduct predetermined maintenance (suction, wiping, capping, etc.) in a state where the maintenance units 34 face nozzle surfaces of the recording heads 32.

Figure 3:
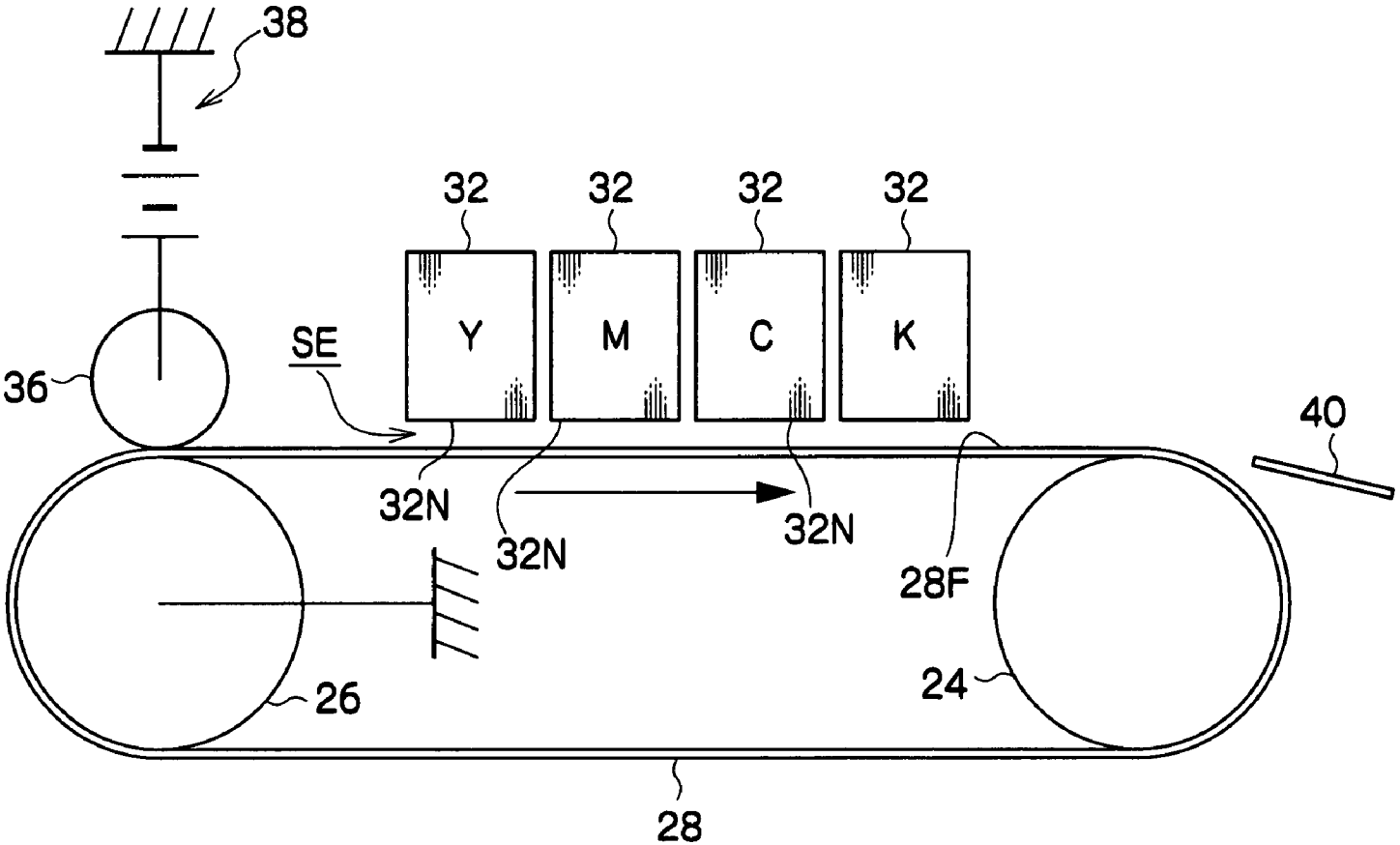
FIG. 3 is a schematic side view showing a printing section in an inkjet recording apparatus.

As shown in FIG. 3, a charge roll 36 connected to a power supply 38 is disposed upstream of the recording head array 30 in the paper conveyance direction. The charge roll 36 follows the rotation of the driven roll 26 while nipping the conveyor belt 28 and the paper P between the charge roll 36 and the driven roll 26, and presses the paper P against the conveyor belt 28. Because a predetermined potential difference arises between the charge roll 36 and the grounded driven roll 26 at this time, the charge roll 36 applies electrical charge to the paper P and causes the paper P to be electrostatically attracted to the conveyor belt 28.

A separation plate 40 is disposed downstream of the recording head array 30 in the paper conveyance direction. The separation plate 40 separates the paper P from the conveyor belt 28, and the separated paper P is conveyed by plural discharge roller pairs 42, which configure a discharge path 44 downstream of the separation plate 40 in the paper conveyance direction, and discharged to a paper discharge tray 46 disposed in the upper portion of the casing 14.

As shown in FIGS. 1 and 2, ink tanks 35 that store inks of the respective colors are disposed above the recording head array 30. The recording heads 32 are connected to the ink tanks 35.

A first embodiment of a charge roll unit disposed with the charge roll 36 will be described.

Figure 4:
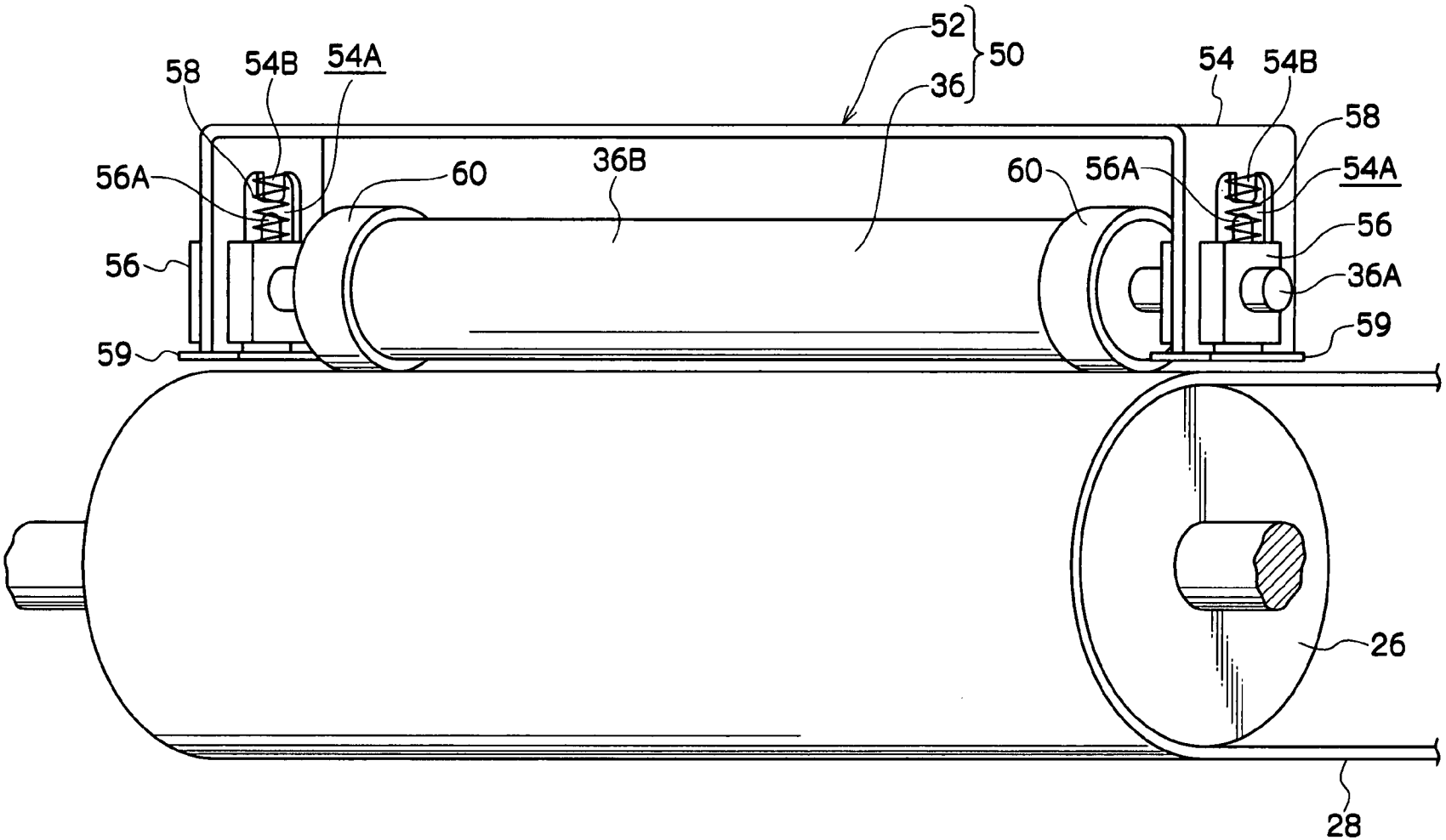
FIG. 4 is a perspective view showing a charge roll unit disposed in an inkjet recording apparatus according to a first embodiment of the invention.
Figure 5:
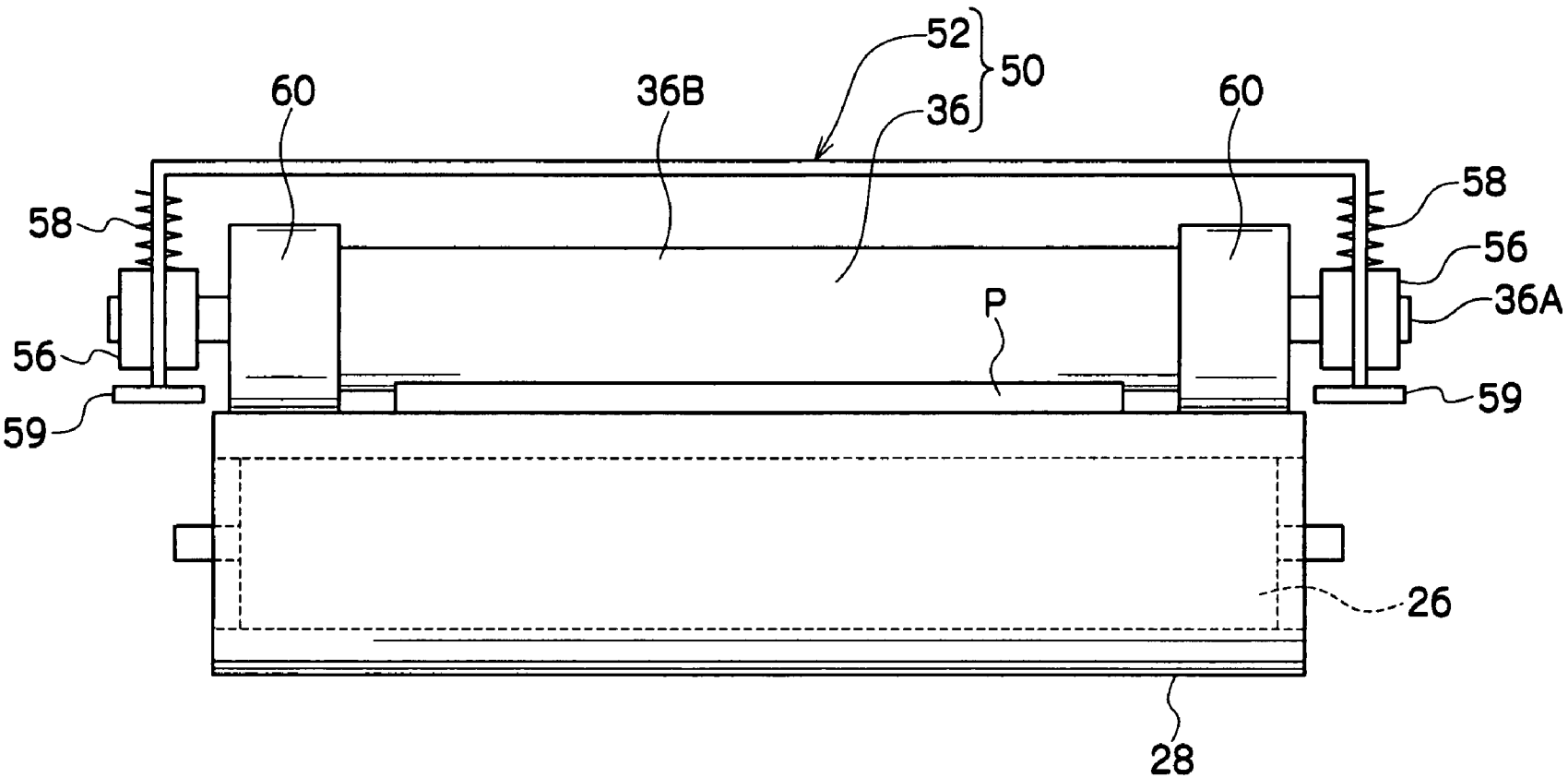
FIG. 5 is a front view showing he charge roll unit disposed in the inkjet recording apparatus according to the first embodiment of the invention.

As shown in FIGS. 4 and 5, a charge roll unit 50 is disposed with the charge roll 36 and a support mechanism 52 that supports the charge roll 36. The support mechanism 52 is disposed with a frame 54, a pair of shaft bearings 56, and a pair of compression coil springs 58 that serve as biasing members.

The frame 54 is supported on a frame (not shown) of the inkjet recording apparatus 12 above the charge roll 36 and extends in the axial direction of the charge roll 36. Both longitudinal-direction end portions of the frame 54 are bent at substantial right angles toward the conveyor belt 28. Substantially U-shaped long holes 54A extending toward the bent portions from both longitudinal-direction end portions are formed in the frame 54. The shaft bearings 56 are fitted into the long holes 54A such that the shaft bearings 56 can slide along the longitudinal direction of the long holes 54A. The shaft bearings 56 rotatably support at least an axial-direction end portion of a rotor shaft 36A of the charge roll 36.

A boss 54B that extends toward the open portion of each of the long holes 54A is formed on one longitudinal-direction end portion of each of the long holes 54A, and a boss 56A that faces the boss 54B is formed on each of the shaft bearings 56. Both end portions of each of the compression coil springs 58 are fitted onto the bosses 54B and the bosses 56A. For this reason, the charge roll 36 is biased by the compression coil springs 58 toward the conveyor belt 28. Further, stoppers 59 are disposed on both longitudinal-direction end portions of the frame 54. The stoppers 59 block the open portions of the long holes 54A to prevent the shaft bearings 56 from escaping from the long holes 54A.

Spacers 60, which are annular members having diameters larger than that of the charge roll 36, are attached to both longitudinal-direction end portions of a roll surface 36B of the charge roll 36. The spacers 60 are insulated, highly rigid members that are not deformed by pressure, and are formed by a resin such as POM, PMMA or PET, or an insulated metal, or a ceramic. For this reason, just the spacers 60 are pressed against the conveyor belt 28 by the biasing force of the compression coil springs 58, and the roll surface 36B of the charge roll 36 and the conveyor belt 28 do not contact each other. Further, it is ensured that electrical current does not flow from the spacers 60 to the conveyor belt 28.

Figure 6:
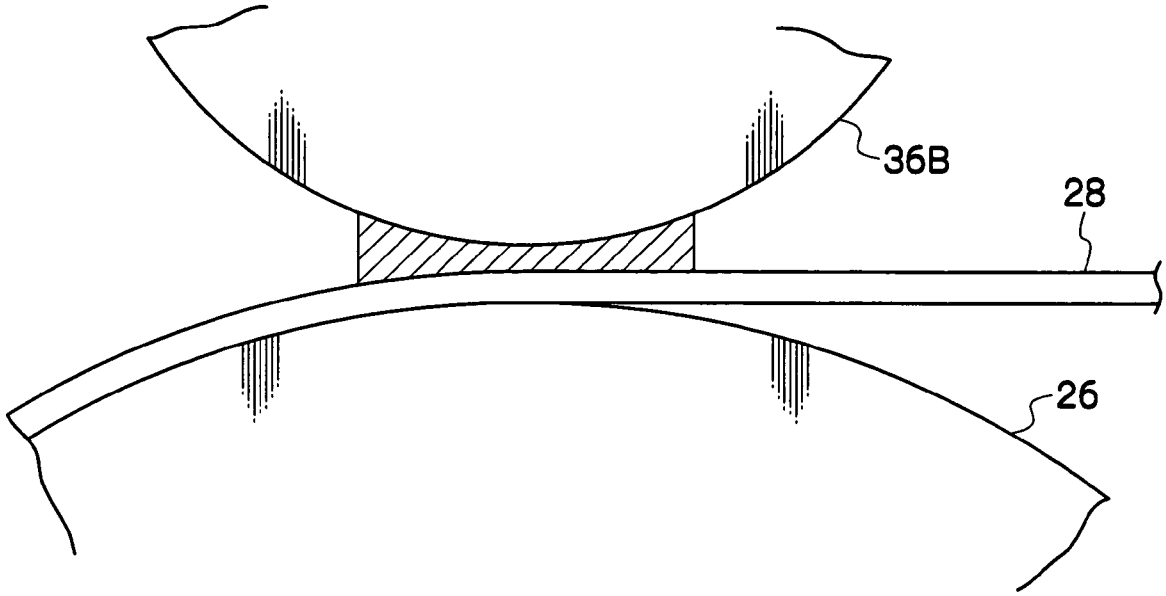
FIG. 6 is a side view schematically showing discharge between a charge roll and a conveyor belt disposed in an inkjet recording apparatus according to embodiments of the invention.

Accordingly, as shown in FIG. 6, all of the movement of electrical charge between the roll surface 36B and the conveyor belt 28 results from discharge, and the surface potential of the conveyor belt 28 is stable. That is, because the surface potential of the conveyor belt 28 can be prevented from rising abnormally, the electrostatic force between the conveyor belt 28 and the recording heads 32 can be prevented from rising abnormally.

Thus, rising of the conveyor belt 28 toward the recording heads 32 can be suppressed, the clearance between the recording heads 32 and the conveyor belt 28 can be made narrower, and the precision of the landing positions of the ink droplets on the paper P can be improved. Further, the range of voltage applied to the charge roll 36 can be expanded to include higher voltage, and the attractive force between the paper P and the conveyor belt 28 can be made stronger. Consequently, uniformity of the throw distance is improved, and similarly, the precision of the landing positions of the ink droplets on the paper P can be improved.

Further, because it is not necessary to make the tension applied to the conveyor belt 28 stronger in order to prevent the conveyor belt 28 from rising, wrinkles generation in the conveyor belt 28 can be suppressed and the conveyance performance of the paper P by the conveyor belt 28 can be improved. The surface potential of the conveyor belt 28 is stable because the gap between the roll surface 36B and the conveyor belt 28 is made constant by the spacers 60 regardless of variations in the thickness of the conveyor belt 28. Further, because the charge roll 36 passively rotates and the discharge space of the roll surface 36B always moves, there is little discharge deterioration. Moreover, because the charge roll 36 is configured to contact only the paper P and not the conveyor belt 28, abrasive deterioration of the charge roll 36 can be reduced.

The gap between the roll surface 36B and the conveyor belt 28 is less than the thickness of the paper P (preferably equal to or less than 0.6×the thickness of the paper P), and the paper P is pressed against the conveyor belt 28 by the roll surface 36B of the charge roll 36. Thus, the electrostatic attractive force between the paper P and the conveyor belt 28 can be efficiently raised, and attractive force between the conveyor belt 28 and the paper P can be ensured.

It will be noted that it is necessary for the gap between the roll surface 36B and the conveyor belt 28 to be 5 μm or greater in consideration of pollution of the roll surface 36B by ink adhering to the conveyor belt 28. It is preferable for the gap to be 20 μm or greater when the machining accuracy of the constituent elements and parts of the charge roll unit 50 is taken into consideration.

A second embodiment of a charge roll unit disposed with the charge roll 36 will be described.

Figure 7:
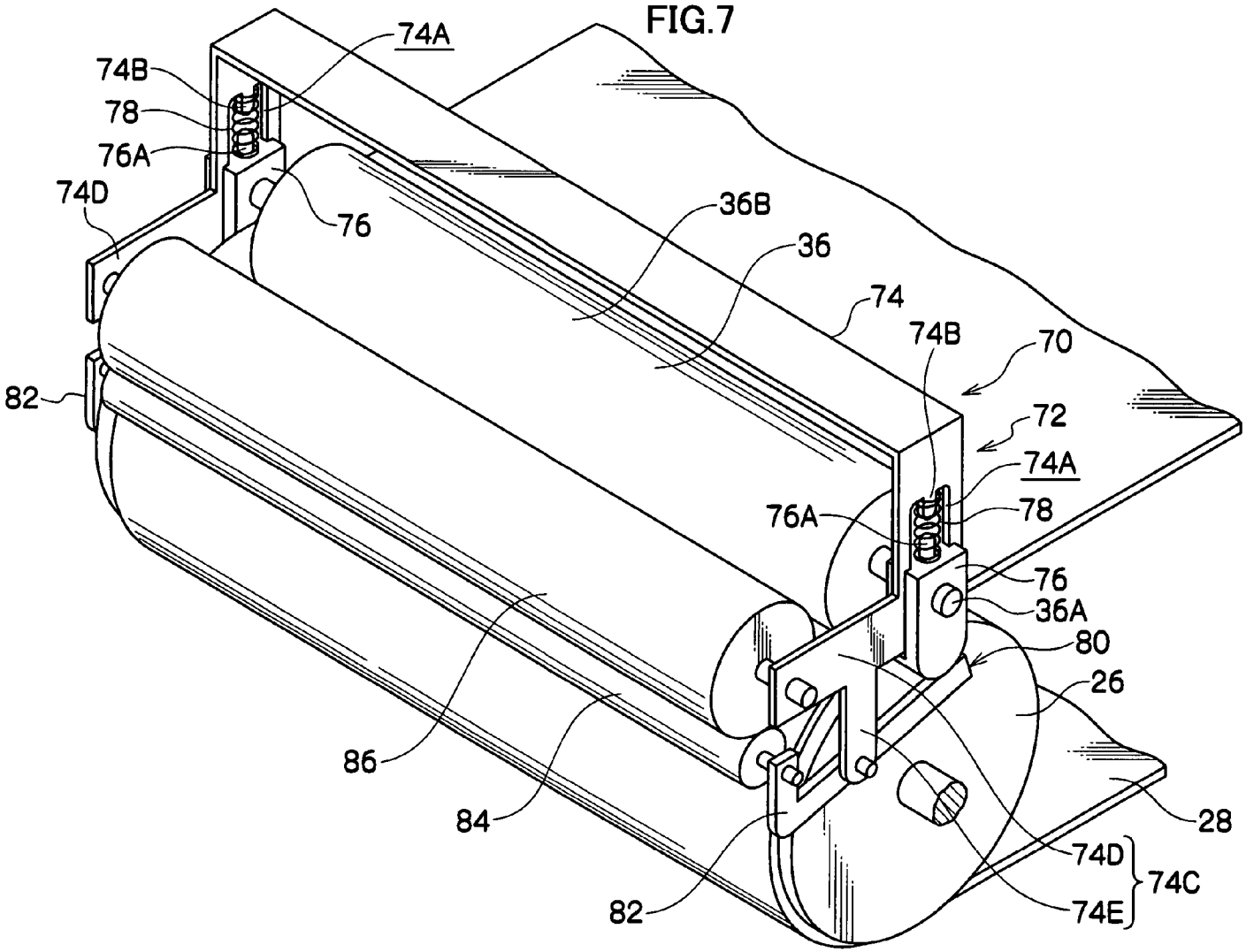
FIG. 7 is a perspective view showing a charge roll unit disposed in the inkjet recording apparatus according to a second embodiment of the invention.
Figure 8:
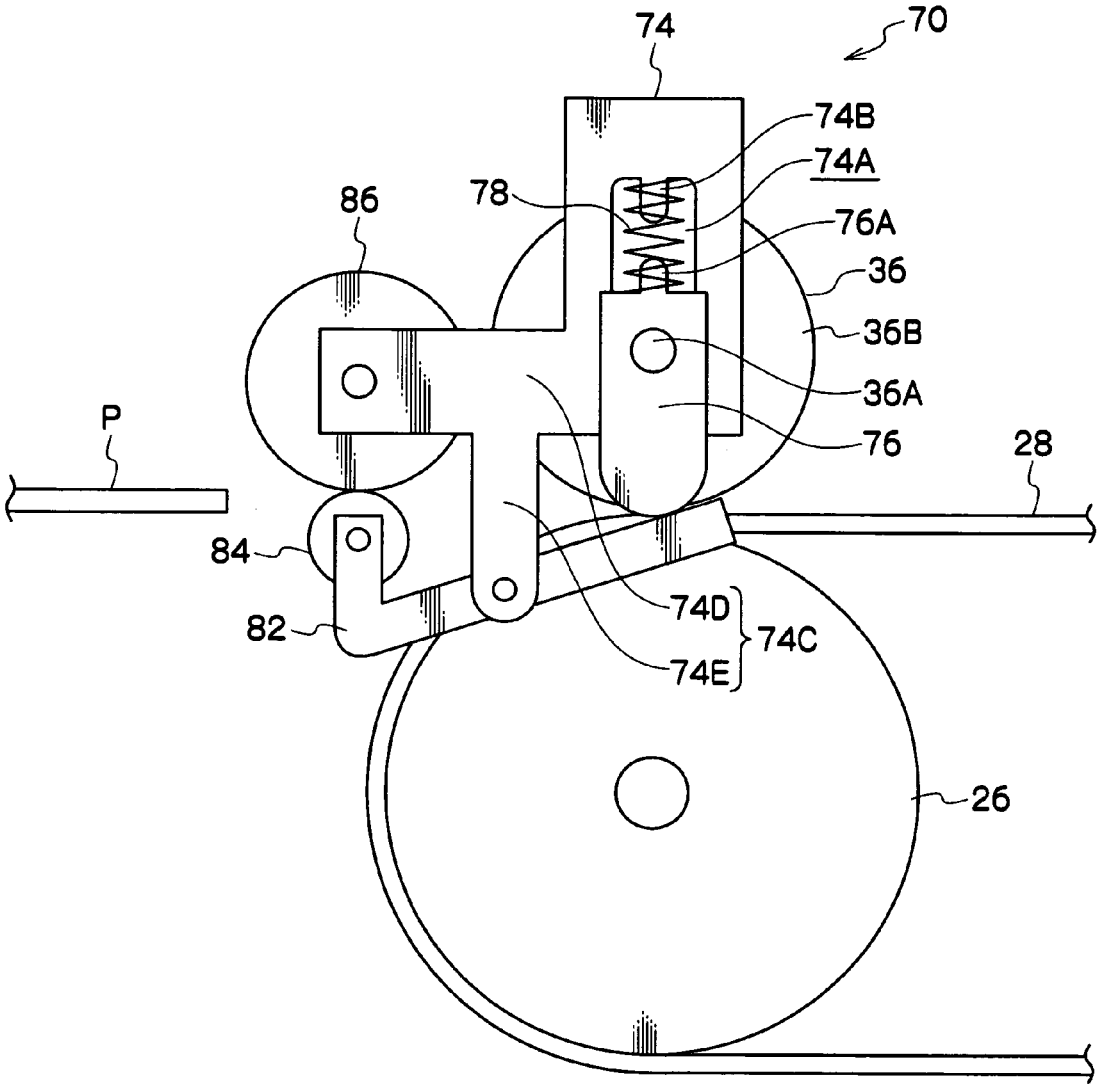
FIG. 8 is a side view showing the charge roll unit disposed in the inkjet recording apparatus according to the second embodiment of the invention.

As shown in FIGS. 7 and 8, a charge roll unit 70 includes the charge roll 36, a support mechanism 72 that supports the charge roll 36, and a link mechanism 80 that moves the charge roll 36 toward and away from the conveyor belt 28. The support mechanism 72 is disposed with a frame 74, a pair of shaft bearings 76, and a pair of compression coil springs 78 that serve as biasing members.

The frame 74 is supported on a frame (not shown) of the inkjet recording apparatus 12 above the charge roll 36 and extends in the axial direction of the charge roll 36. Both longitudinal-direction end portions of the frame 74 are bent at substantial right angles toward the conveyor belt 28. Substantially U-shaped long holes 74A extending toward the bent portions from both longitudinal-direction end portions are formed in the frame 74. The shaft bearings 76 are fitted into the long holes 74A such that the shaft bearings 76 can slide along the longitudinal direction of the long holes 74A. The shaft bearings 76 rotatably support at least one axial-direction end portions of the rotor shaft 36A of the charge roll 36.

A boss 74B that extends toward the open portion of each of the long holes 74A is formed on one longitudinal-direction end portion of each of the long holes 74A, and a boss 76A that faces the boss 74B is formed on each of the shaft bearings 76. Both end portions of each of the compression coil springs 78 are fitted onto the bosses 74B and the bosses 76A. Accordingly, the charge roll 36 is biased by the compression coil springs 78 toward the conveyor belt 28.

A link mechanism support piece 74C that extends upstream in the paper conveyance direction is integrally formed on both longitudinal-direction end portions of the frame 74. Each of the link mechanism support pieces 74C is configured by a roll support portion 74D, which extends substantially horizontally and longitudinally upstream in the conveyance direction, and a link support portion 74E, which extends substantially perpendicularly to and longitudinally downward from the longitudinal-direction center portion of the roll support portion 74D.

The link mechanism 80 is configured by arms 82 whose longitudinal-direction center portions are pivotably supported on the end portions of the link support portions 74E, a roll 84 that is rotatably supported on one longitudinal-direction end portion of each of the arms 82, and a roll 86 that is rotatably supported on the end portions of the roll support portions 74D.

Because the arms 82 support the roll 86 on one of each of their longitudinal-direction end portions, they try to pivot in the direction where their other longitudinal-direction end portions move upward (counter-clockwise direction in the drawings), but the other longitudinal-direction end portions of the arms 82 are configured to abut against rounded portions formed on the undersides of the shaft bearings 76 so that the pivoting of the arms 82 is stopped. Further, the arms 82 receive the biasing force of the compression coil springs 78 via the shaft bearings 76 and try to pivot in the direction where their other longitudinal-direction end portions move downward (clockwise direction in the drawings), but the roll 84 is configured to abut against the roll 86 so that the pivoting of the arms 82 is stopped.

In this state, each part is set such that the roll surface 36B of the charge roll 36 does not contact the conveyor belt 28 and such that the nip portion between the roll 84 and the roll 86 is positioned at the height of the gap between the roll surface 36B and the conveyor belt 28. Similar to the first embodiment, it is necessary for the gap between the roll surface 36B and the conveyor belt 28 in this state to be 5 μm or greater and preferably 20 μm or greater.

Figure 9:
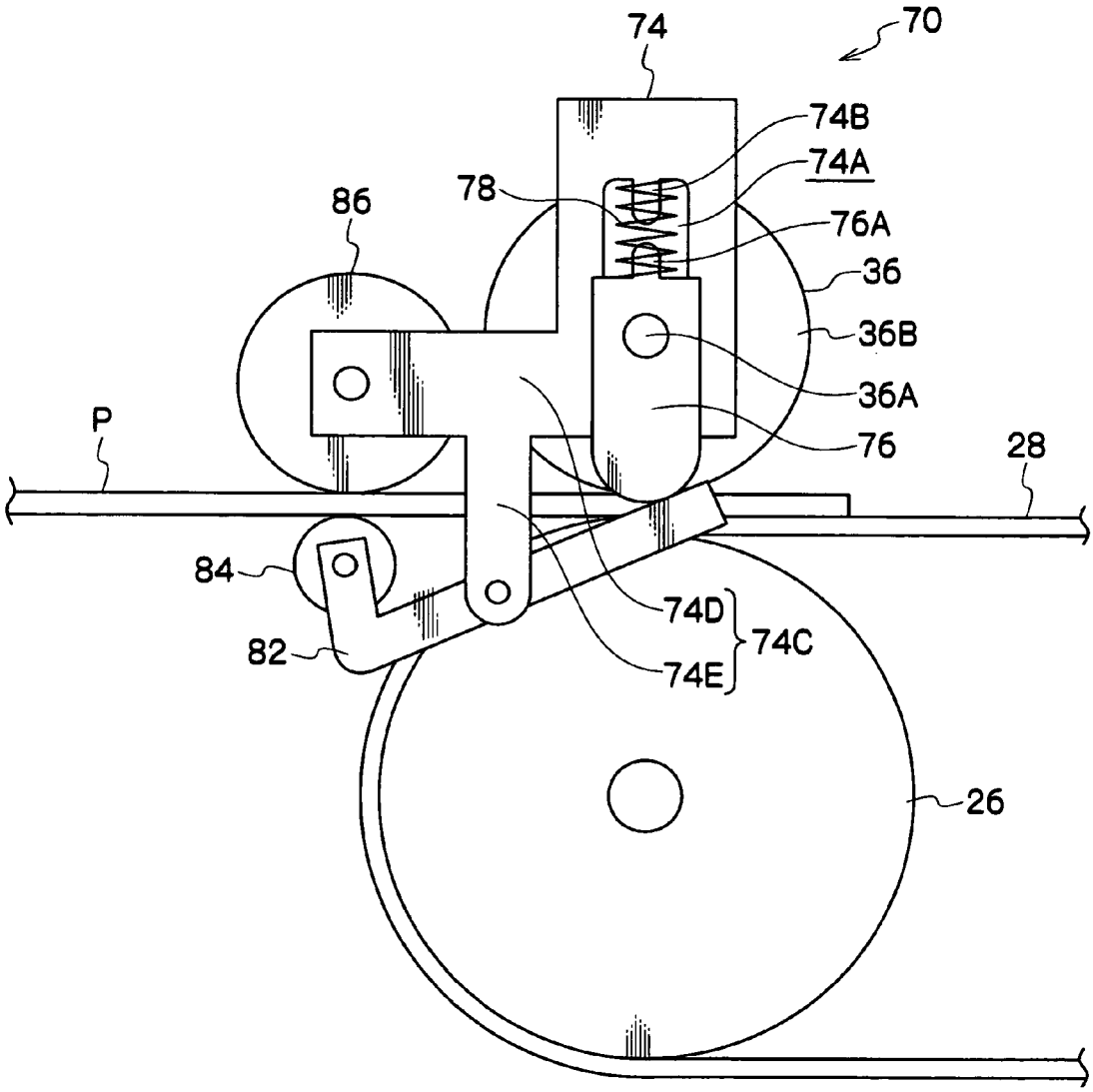
FIG. 9 is another side view showing the charge roll unit disposed in the inkjet recording apparatus of the second embodiment of the invention.
Figure 10:
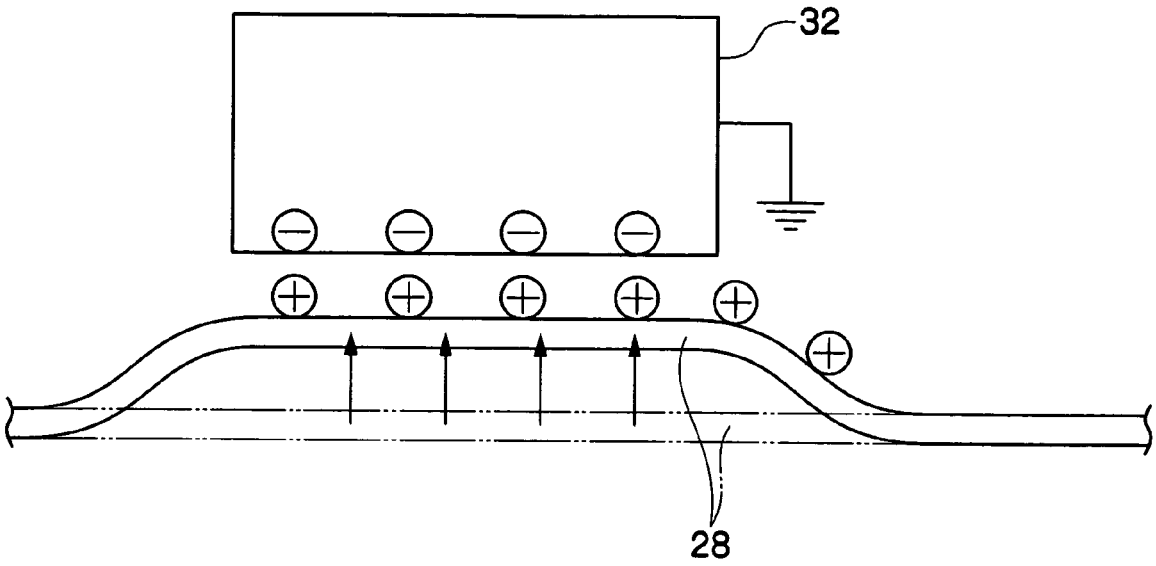
FIG. 10 is a side view schematically showing a recording head and a conveyor belt in a conventional inkjet recording apparatus.
Figure 11:
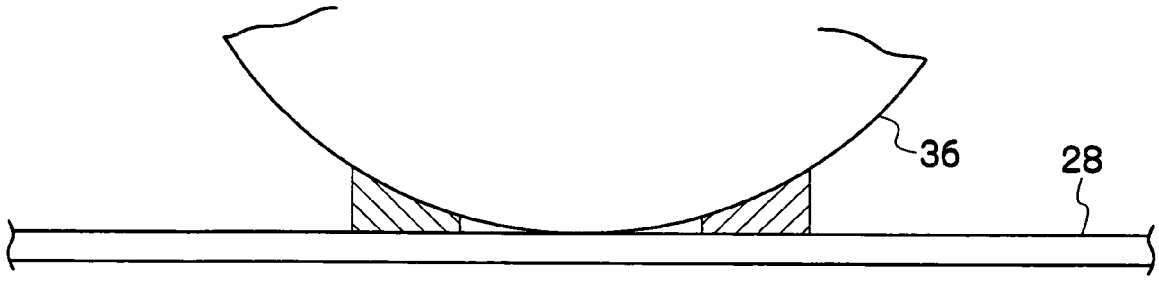
FIG. 11 is a side view schematically showing discharge between a charge roll and the conveyor belt in a conventional inkjet recording apparatus.
Figure 12:
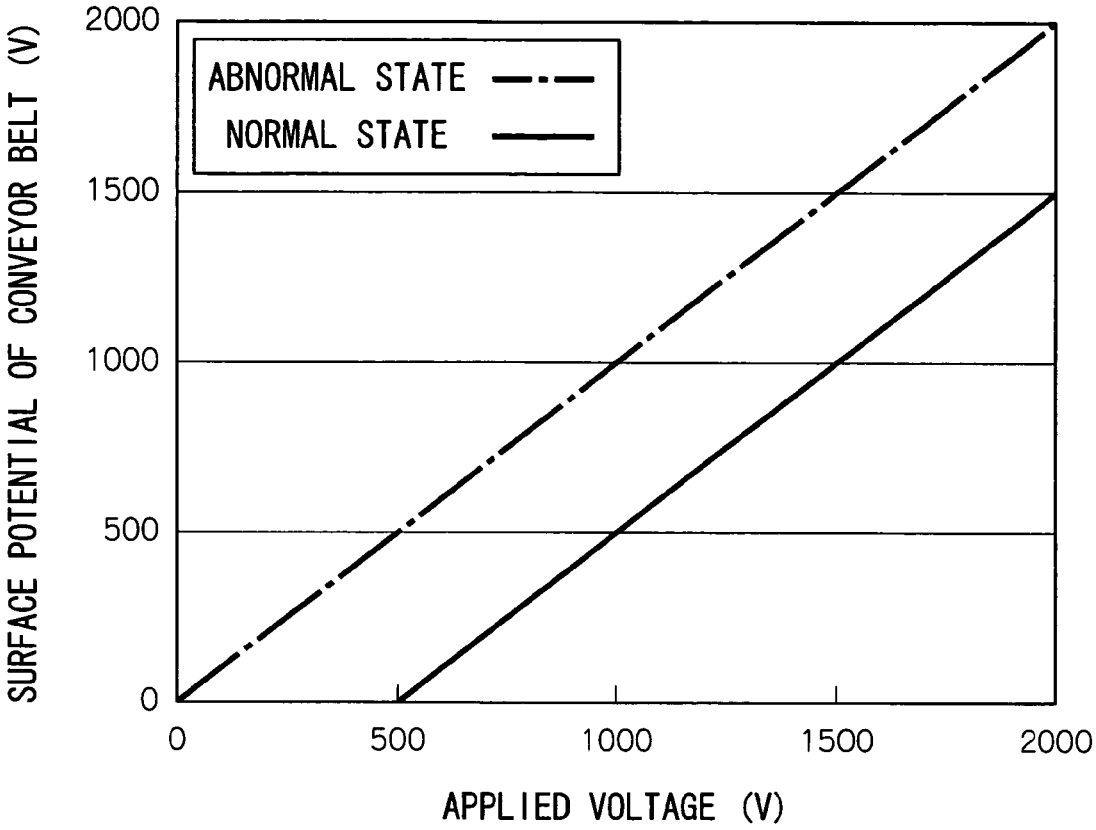
FIG. 12 is a graph showing the relationship between voltage applied to a charge roll and a surface potential of a conveyor belt in a conventional inkjet recording apparatus.

Additionally, as shown in FIG. 9, when the paper P is conveyed to the nip portion between the roll 84 and the roll 86, the roll 84 is pushed down by the paper P a distance equal to the thickness of the paper P and the arms 82 pivot in the counter-clockwise direction in FIG. 9. Thus, the shaft bearings 76 are pushed up and the charge roll 36 rises. Each part is set such that the gap between the roll surface 36B and the conveyor belt 28 becomes less than the thickness of the paper P (preferably equal to or less than 0.6×the thickness of the paper P).

That is, the-gap between the roll surface 36B and the conveyor belt 28 is configured to change in accordance with the thickness of the paper P. For this reason, differences in the force with which the charge roll 36 presses the paper P against the conveyor belt 28 that occur due to differences in the thickness of the paper P can be suppressed, and the paper P can be stably attracted to the conveyor belt 28 regardless of differences in the thickness of the paper P.

Further, there is little abrasive deterioration of the roll surface 36B because the roll surface 36B contacts the conveyed paper P only when the paper P passes between the charge roll 36 and the conveyor belt 28 and does not contact anything else at any other time.

Further, because a member that directly contacts the conveyor belt 28, such as the spacers 60 of the first embodiment, is not present in the periphery of the charge roll 36, abrasive deterioration and the conveyance load of the conveyor belt 28 can be further reduced.

In the present embodiment, the charge roll 36 is moved up and down in accordance with the thickness of the paper P using the link mechanism 80 that is displaced a distance equal to the thickness of the paper P. However, the invention may also be configured such that a motor or solenoid is used as the mechanism that causes the charge roll 36 to be displaced, so that the gap between the roll surface 36B and the conveyor belt 28 is increased and reduced by driving the motor or solenoid in accordance with the detected thickness of the paper P. In this case, it is preferable to increase the gap between the charge roll 36 and the conveyor belt 28 when no paper P is present in order to prevent ink and foreign matter from adhering to the charge roll 36, and to reduce the size of the gap to the desired size when the paper P reaches the nip portion.

Further, the gap may also be adjusted in synchronization with the selection of paper by software when printing is to be executed. The size of the gap may also be adjusted manually by a user using a manual mechanism that causes the charge roll 36 to be displaced.

Moreover, the invention may also be configured such that the charge roll 36 presses the paper P against the conveyor belt 28 with its own weight. In this case, the charge roll 36 may be configured such that it is suspended at a position where it abuts against thin paper and is moved upward (recedes from the conveyor belt 28) by thicker paper. Thus, differences in the force can be suppressed when the charge roll 36 presses the paper P against the conveyor belt 28 that occur due to differences in the thickness of the paper P. It will be noted that the pressing force of the charge roll 36 can be adjusted by changing the material, length, and diameter of the rotor shaft 36A of the charge roll 36.

In the first and second embodiments, the present invention was exemplified using an inkjet recording apparatus as an example, but the present invention is not limited to inkjet recording apparatus and can be applied to all liquid droplet ejection apparatus directed toward various industrial purposes, such as the manufacture of display-use color filters, which is conducted by ejecting colored ink onto polymer film, and the formation of electroluminescent display panels, which is conducted by ejecting an organic electroluminescent solution onto a substrate.

Further, the "recording medium" serving as the object of image recording in the liquid droplet ejection apparatus of the present invention widely includes objects onto which a liquid droplet ejection head ejects liquid droplets. Consequently, recording paper and overhead projector sheets are of course included in the recording media, and polymer film is also included.

Moreover, in the first and second embodiments, the present invention was exemplified using an example configuration where plural inkjet recording heads that were longer than the width of the paper P were arranged in the conveyance direction of the paper P and unitized, but the present invention is not limited to this. For example, the present invention can also be applied to a configuration where inkjet recording heads that are shorter than the width of the paper P are moved in the width direction of the paper P.

In the liquid droplet ejection apparatus of the present invention, when the conveyor belt conveys the recording medium while causing the recording medium to face the liquid droplet ejection head, the charge roll causes the recording medium to be electrostatically attracted to the conveyor belt. Consequently, the uniformity of the distance between the liquid droplet ejection head and the recording medium becomes greater, and the precision of the landing positions of the liquid droplets on the recording medium becomes higher.

The charge roll is configured such that it does not contact the conveyor belt. Accordingly, all of the movement of electrical charge between the charge roll and the conveyor belt results from discharge. Thus, an abnormal rise in the surface potential of the conveyor belt can be prevented, and drawing of the conveyor belt toward the liquid droplet ejection head due to electrostatic force can be suppressed.

Further, the gap between the charge roll and the conveyor belt is less than the thickness of the recording medium. Accordingly, because the recording medium is pressed against the conveyor belt by the charge roll, the electrostatic attractive force between the conveyor belt and the recording medium can be raised efficiently and ensured.

In the above-described aspect, the gap between the charge roll and the conveyor belt may be formed by disposing a spacer member. The spacer member may have circumferential surface whose diameter is larger than that of the charge roll and which abut against the conveyor belt, and the gap may be formed by disposing the spacer member on both axial-direction end portions of the charge roll.

Thus, the gap between the charge roll and the conveyor belt is formed as a result of the spacer members abutting against the conveyor belt.

When the spacer member is insulated, there is no movement of electrical charge at the portion where the spacer member contacts the conveyor belt, and all of the movement of electrical charge from the charge roll to the conveyor belt results from discharge. Thus, an abnormal rise in the surface potential of the conveyor belt can be prevented.

In the above-described aspect, the gap may also be formed by disposing a support member that supports the charge roll away from the conveyor belt.

Because the gap between the charge roll and the conveyor belt is formed as a result of the support member, there is no member present which directly contacts the conveyor belt, and abrasive deterioration and the conveyance load of the conveyor belt can be reduced.

In the above-described aspect of the invention, a gap increasing/decreasing member may be disposed which increases and decreases the gap by moving the charge roll toward and away from the conveyor belt in accordance with the thickness of the recording medium.

Thus, because differences in the force with which the charge roll presses the recording medium against the conveyor belt can be suppressed, which is caused by differences in the thickness of the recording medium, the recording medium can be stably attracted to the conveyor belt regardless of differences in the thickness of the recording medium.

The gap between the charge roll and the conveyor belt may be equal to or less than 60% of the thickness of the recording medium, or may also be 5 μm or greater.

Thus, attractive force between the conveyor belt and the recording medium can be ensured, and drawing of the conveyor belt toward the liquid droplet ejection head by electrostatic force can be suppressed.

What is claimed is:

1. A liquid droplet ejection apparatus comprising:

a liquid droplet ejection head that ejects liquid droplets;

a conveyor belt that retains and conveys a recording medium while causing the recording medium to face the liquid droplet ejection head;

a charge roll that applies a charge to the recording medium and causes the recording medium to be electrostatically attracted to the conveyor belt; and a link mechanism including a support member and a feeding roll that is linked to the support member, the feeding roll being pushed down by a distance substantially equal to the thickness of the recording medium as the recording medium is fed over the feeding roll and the support member is caused to support the charge roll away from the conveyor belt such that a gap is formed between the charge roll and the conveyor belt having a distance that is a constant proportion of the thickness of the recording medium;

wherein the charge roll and the conveyor belt are configured to not contact each other, and a gap between the charge roll and the conveyor belt is less than the thickness of the recording medium so that the charge roll presses the recording medium against the conveyor belt.

2. The liquid droplet ejection apparatus of claim 1, wherein the gap is equal to or less than 60% of the thickness of the recording medium.

3. The liquid droplet ejection apparatus of claim 1, wherein the gap is 5 μm or greater.

4. The liquid droplet ejection apparatus of claim 1, wherein the gap is 20 μm or greater.

5. A liquid droplet ejection apparatus comprising:

a liquid droplet ejection head that ejects liquid droplets;

a conveyor belt that retains and conveys a recording medium while causing the recording medium to face the liquid droplet ejection head;

a charge roll that applies a charge to the recording medium and causes the recording medium to be electrostatically attracted to the conveyor belt;

a support mechanism that supports the charge roll, the support mechanism including a frame having long holes, roll support portions, and link support portions;

the support mechanism further including shaft bearings fitted in and slidable along the long holes, the shaft bearings supporting the charge roll, and resilient members that bias the charge roll toward the conveyor belt; and a link mechanism that moves the charge roll toward and away from the conveyor belt, the link mechanism including arms that are pivotally supported by the link support portions of the frame and that abut against the shaft bearings and are biased by the resilient members, a roll rotatably supported by the roll support portions of the frame, and a roll rotatably supported by the arms and abutting against the roll supported by the roll support portions, wherein a gap between the charge roll and the conveyor belt is less than the thickness of the recording medium so that the charge roll presses the recording medium against the conveyor belt, a nip portion between the roll supported by the roll support portion and the roll supported by the arms is positioned at the height of the gap, and the gap is thereby configured to change in accordance with a thickness of the recording medium fed through the nip portion.

6. The liquid droplet ejection apparatus of claim 5, wherein the gap is equal to or less than 60% of the thickness of the recording medium.

7. The liquid droplet ejection apparatus of claim 5, wherein the gap is 5 μm or greater.

8. The liquid droplet ejection apparatus of claim 5, wherein the gap is 20 μm or greater.

* * * * *